US008171924B2

(12) United States Patent
Karlovsky et al.

(10) Patent No.: US 8,171,924 B2
(45) Date of Patent: May 8, 2012

(54) VARIABLE OPEN-CLOSED CRANKCASE BREATHER SYSTEM FOR BLOW-BY GAS

(75) Inventors: Frank J. Karlovsky, Bloomingdale, IL (US); Joshua Schueler, New Lenox, IL (US); Jorge Fernandez, Chicago, IL (US); Christofer J. Palumbo, Elmwood Park, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 481 days.

(21) Appl. No.: 12/533,291

(22) Filed: Jul. 31, 2009

(65) Prior Publication Data

US 2011/0023850 A1 Feb. 3, 2011

(51) Int. Cl.
*F02B 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 3,662,723 | A * | 5/1972 | Buhl | 123/572 |
| 5,937,837 | A * | 8/1999 | Shaffer et al. | 123/573 |
| 6,460,525 | B1 * | 10/2002 | Shureb | 123/572 |
| 6,691,687 | B1 * | 2/2004 | Liang et al. | 123/572 |
| 7,168,421 | B2 * | 1/2007 | Blom | 123/573 |
| 2007/0251235 | A1 * | 11/2007 | Schmid et al. | 60/605.2 |

* cited by examiner

*Primary Examiner* — M. McMahon

(74) *Attorney, Agent, or Firm* — Mark C. Bach; Jeffrey P. Calfa

(57) ABSTRACT

A method of selectively directing a flow of blow-by gas (F) in a vehicle having an engine (14) and a turbocharger compressor (32) includes the steps of providing fluid communication for the flow of blow-by gas from the engine to a valve (12), actuating the valve with a valve actuator (38) to at least one of a closed system position and an open system position, and selectively directing the flow of blow-by gas from the valve to at least one of the turbocharger compressor and an atmosphere (28).

17 Claims, 1 Drawing Sheet

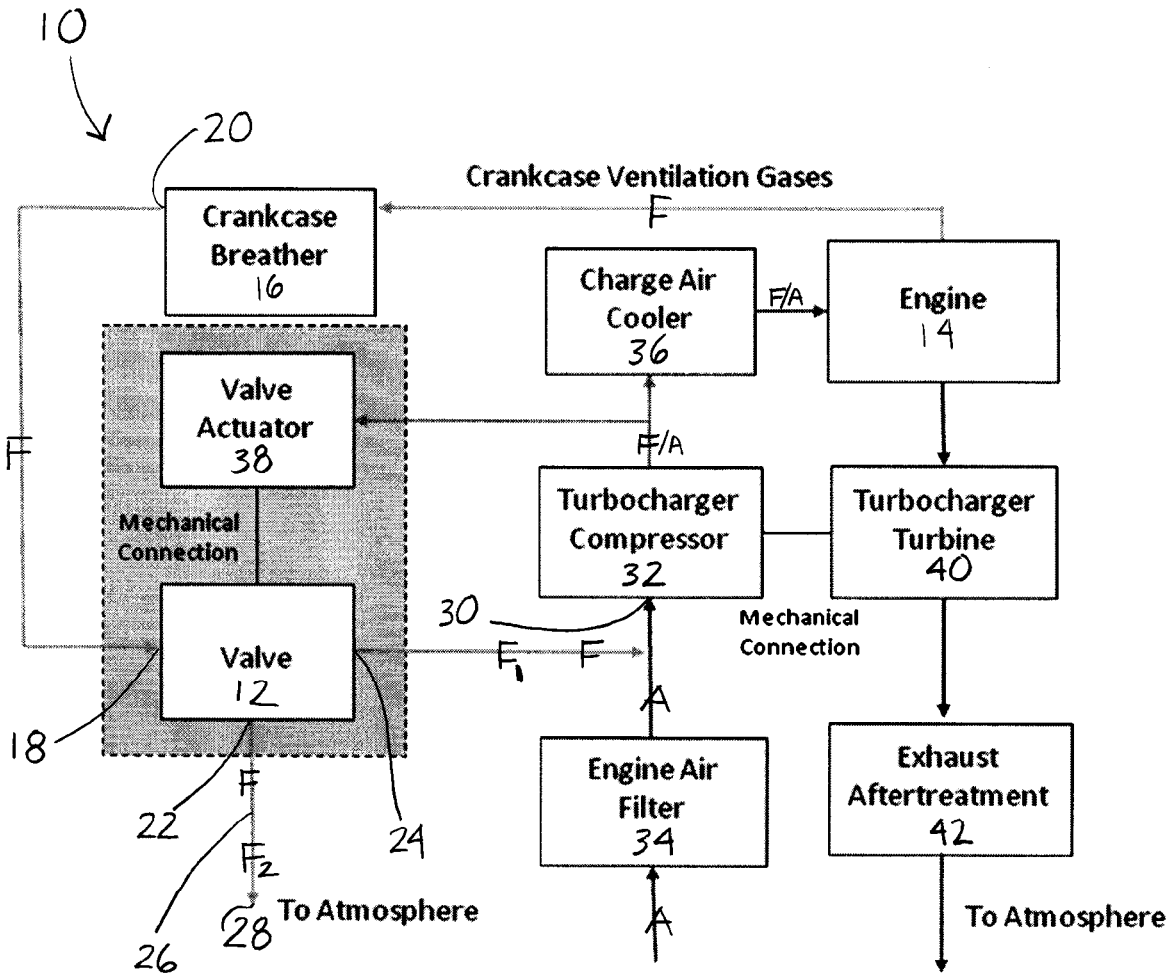
10
20
Crankcase Ventilation Gases
F
Crankcase Breather 16
Charge Air Cooler 36
F/A
Engine 14
Valve Actuator 38
F
F/A
Mechanical Connection
Turbocharger Compressor 32
Turbocharger Turbine 40
30
Mechanical Connection
Valve 12
F1
F
A
18
22
24
F
F2
26
28
To Atmosphere
Engine Air Filter 34
A
Exhaust Aftertreatment 42
To Atmosphere

VARIABLE OPEN-CLOSED CRANKCASE BREATHER SYSTEM FOR BLOW-BY GAS

BACKGROUND

Embodiments described herein relate generally to ventilation of a combustion engine. More specifically, embodiments described herein relate to a ventilation system for blow-by gas in a combustion engine.

During operation of a combustion engine, gas is pressed out of the combustion chamber and into a crankcase through a gap between a piston ring and a cylinder wall. Gas may also come from valve stem seals and turbocharger seals. This gas, which includes hydrocarbon gases, water vapor, and a small amount of entrained liquid oil, is called blow-by gas. Unless removed from the crankcase, the blow-by gas increases the pressure inside the crankcase.

Conventionally, the blow-by gas may be vented from the crankcase with a crankcase ventilation system, also called a crankcase breather system. In an open crankcase ventilation system, the crankcase breather system vents to the atmosphere. Blow-by gas is one component of the vehicle's overall emissions, and as such, is an emission that the industry attempts to mitigate. Further, blow-by gas can produce noxious odors, which may present an issue when the vehicle is stationary.

Another conventionally known crankcase ventilation system is a closed crankcase breather system, where the blow-by gas can be vented back to the engine, for example by first being vented to a turbocharger compressor. Venting blow-by gas to the engine intake/turbocharger compressor inlet can potentially contaminate the air intake hardware of the engine/turbocharger compressor. Under high temperatures and high loading of blow-by gases, the oil entrained in the blow-by gas can harden and stick to the engine/turbocharger compressor. The hardening and sticking process of the oil from the blow-by gas is known as coking, which can reduce turbocharger compressor efficiency, thereby increasing engine emissions, and ultimately lead to failure of the engine/turbocharger compressor.

SUMMARY OF THE INVENTION

A method of selectively directing a flow of blow-by gas in a vehicle having an engine and a turbocharger compressor includes the steps of providing fluid communication for the flow of blow-by gas from the engine to a valve, actuating the valve with a valve actuator to at least one of a closed system position and an open system position, and directing the flow of blow-by gas from the valve to at least one of the turbocharger compressor and an atmosphere.

BRIEF DESCRIPTION OF THE DRAWINGS

FIG. 1 is a flow-diagram of a variable open-closed crankcase breather system in fluid communication with a turbocharger compressor and an engine.

DETAILED DESCRIPTION

Referring now to FIG. 1, a variable open-closed crankcase breather system is indicated generally at 10 and includes a valve 12 in downstream fluid communication with an engine 14. Although the valve 12 is described as a three-way valve, it is contemplated that the valve can join more than three lines, for example a four-way valve or a five-way valve. It is contemplated that the valve 12 may be formed of stainless steel or other corrosion resistant materials.

The engine 14 emits a flow of blow-by gas F from a crankcase breather 16, which in the direction of flow of blow-by gas, is downstream of the engine 14 and upstream from the three-way valve 12. The crankcase breather 16 may be assembled to the engine 14, and may include a breather oil mist separator (not shown), which may remove some of the entrained oil hydrocarbons contained in the flow of blow-by gas F.

In the direction of flow of blow-by gas F, an inlet 18 of the three-way valve 12 is in downstream fluid communication with an outlet 20 of the crankcase breather 16. After the flow of blow-by gas F enters the three-way valve 12, the blow-by gas can flow to one of two outlets, an open system outlet 22 or a closed system outlet 24. It should be appreciated that fluid communication between components, including but not limited to the engine 14, the crankcase breather 16, the valve 12 and the turbocharger compressor 32, may be provided by tubes, conduits, vessels or any other channels that convey fluids.

When the three-way valve 12 is in an open system position, the flow of blow-by gas is directed out the open system outlet 22 to a tube or conduit 26 that vents to the atmosphere 28. In the open system position, the variable open-closed crankcase breather system 10 is an open system. Valve 12 is closed to the turbocharger compressor 32 in the open system position.

When the three-way valve 12 is in a closed system position, the flow of blow-by gas is directed out the closed system outlet 24 to an inlet 30 of a turbocharger compressor 32. In the closed system position, the variable open-closed crankcase breather system 10 is a closed system that is it is closed to the atmosphere 28.

The closed system outlet 24 of the three-way valve 12 is in upstream fluid communication with the inlet 30 of the turbocharger compressor 32. The flow of blow-by gas F may be combined with a flow of air A from an engine air filter 34. From the turbocharger compressor 32, the blow-by gas flows to the engine 14, and may flow through a charge air cooler 36 between the turbocharger compressor 32 and the engine.

The three-way valve 12 selectively permits the flow of blow-by gas F to the turbocharger compressor 32 or to the atmosphere 28. The closed system position directing the flow of blow-by gas F to the turbocharger compressor 32 is the default position of the three-way valve 12. When the pressure in the turbocharger compressor 32 reaches a predetermined level indicating a predetermined loading on the engine 14, a valve actuator 38 actuates or switches the three-way valve 12 to the open system position, which vents the flow of blow-by gas F to the atmosphere 28.

The loading on the engine 14 may be determined indirectly through a turbocharger turbine 40, which receives exhaust from the engine. The turbocharger turbine 40 is mechanically linked to the turbocharger compressor 32 to power the compressor. The valve actuator 38 may be actuated by the discharge air pressure downstream of the turbocharger compressor 32.

It is possible that the valve 12 may have an additional outlet, for example a four-way valve for directing a flow of blow-by gas F to an aftertreatment system of a vehicle 42. Additionally, it is possible that the valve 12 may have a third position, where the valve directs portions of the flow of blow-by gas F from the engine 14 out more than one outlet, for example a first portion of the flow of blow-by gas $F_1$ is directed to the turbocharger compressor 32, and a second portion of the flow of blow-by gas $F_2$ is directed to the atmosphere 28.

In the variable open-closed crankcase breather system 10, the valve actuator 38 is mechanically connected to the three-way valve 12, however other connections, such as electrical or pneumatic, are possible. In the open-closed system 10, the valve actuator 38 is pneumatic, driven by boost air. Alternatively, the engine 14 may directly actuate the valve actuator 38, either mechanically, electrically or pneumatically. It is also possible that the valve actuator 38 may be controlled by the user/driver of the vehicle to selectively actuate the valve 12 to the open system position or the closed system position. It is possible that the engine control module (not shown) may control the valve actuator 38 and the valve 12.

The variable open-closed crankcase breather system 10 allows the selective closed ventilation to the turbocharger compressor 32, for example when emitting blow-by gas to the atmosphere 28 may cause noxious odors, such as when the engine 14 is idling. Further, the variable open-closed crankcase breather system 10 allows the selective open ventilation to the atmosphere 28, for example when high flow rates of blow-by case through the turbocharger compressor 32 may cause coking of the turbocharger compressor.

What is claimed is:

1. A variable open-closed crankcase breather system for a vehicle having an engine emitting blow-by gas and a turbocharger compressor, the system comprising:

a valve disposed in downstream fluid communication with the engine to receive blow-by gas, a closed system outlet of the valve in upstream fluid communication with respect to the turbocharger compressor;

an open system outlet of the valve in upstream fluid communication with an atmosphere; and a valve actuator configured to actuate the valve, wherein the valve is selectively moveable to a closed system position permitting a flow of blow-by gas out the closed system outlet and to the turbocharger compressor, and is selectively moveable to an open system position permitting a flow of blow-by gas out the open system outlet and to the atmosphere, wherein the valve actuator switches the valve to the open system position when the pressure in the turbocharger compressor reaches a predetermined level.

2. The variable open-closed crankcase breather system of claim 1 wherein the valve is a three-way valve.

3. The variable open-closed crankcase breather system of claim 1 wherein the valve actuator is actuated by the discharge air pressure downstream of the turbocharger compressor.

4. The variable open-closed crankcase breather system of claim 1 wherein the valve actuator is mechanically connected to the valve.

5. The variable open-closed crankcase breather system of claim 2 wherein the engine actuates the valve actuator.

6. The variable open-closed crankcase breather system of claim 1 wherein when the valve is in the open system position, blow-by gas flows through a tube that vents to the atmosphere.

7. The variable open-closed crankcase breather system of claim 1 wherein the valve has a third position, wherein when the valve is in the third position, a first portion of the blow-by gas flows to the turbocharger compressor, and a second portion of the blow-by gas flows to the atmosphere.

8. The variable open-closed crankcase breather system of claim 1 wherein when the valve is in the closed system position, the flow of blow-by gas is combined with a flow of air from an engine air filter.

9. A method of selectively directing a flow of blow-by gas in a vehicle having an engine and a turbocharger compressor, the method comprising:

providing fluid communication for the flow of blow-by gas from the engine to a valve;

actuating the valve with a valve actuator to at least one of a closed system position and an open system position;

selectively directing the flow of blow-by gas from the valve to at least one of the turbocharger compressor and an atmosphere; and selectively permitting the flow of blow-by gas to one of the turbocharger compressor and the atmosphere based on pressure in the turbocharger compressor reaching a predetermined level.

10. The method of claim 9 wherein the step of actuating the valve with the valve actuator is mechanically actuated.

11. The method of claim 9 further comprising the step of combining the flow of blow-by gas with a flow of air from an engine air filter upstream of the turbocharger compressor.

12. The method of claim 9 further comprising the step of controlling the valve actuator to selectively actuate the valve to the open system position or the closed system position, wherein the user/driver controls the valve actuator.

13. A variable open-closed crankcase breather system of a vehicle having an engine emitting a flow of blow-by gas, the system comprising:

a three-way valve disposed in downstream fluid communication with the engine to receive the flow of blow-by gas from the engine, the three-way valve having a closed system outlet and an open system outlet;

a turbocharger compressor disposed downstream of the three-way valve and in fluid communication with the closed system outlet for receiving the flow of blow-by gas, the turbocharger compressor disposed in upstream fluid communication with the engine for permitting the flow of blow-by gas to the engine;

a valve actuator configured to actuate the three-way valve, wherein the three-way valve is selectively moveable to the closed system position permitting the flow of blow-by gas to the turbocharger compressor, and from the turbocharger to the engine, and wherein the three-way valve is selectively moveable to the open system position permitting the flow of blow-by gas to the atmosphere, wherein the valve actuator switches the three-way valve to the open system position when the pressure in the turbocharger compressor reaches a predetermined level.

14. The variable open-closed crankcase breather system of claim 13 further comprising a crankcase breather disposed in downstream fluid communication from the engine to receive the flow of blow-by gas from the engine.

15. The variable open-closed crankcase breather system of claim 13 wherein the valve actuator is actuated by the discharge air pressure downstream of the turbocharger compressor.

16. The variable open-closed crankcase breather system of claim 13 wherein the three-way valve has a third position, wherein when the three-way valve is in the third position, a first portion of the blow-by gas flows to the turbocharger compressor, and a second portion of the blow-by gas vents to the atmosphere.

17. The variable open-closed crankcase breather system of claim 13 wherein when the three-way valve is in the closed system position, the flow of blow-by gas is combined with a flow of air from an engine air filter.

* * * * *